United States Patent [19]

Mabuchi et al.

[11] 4,168,468

[45] Sep. 18, 1979

[54] RADIO MOTOR CONTROL SYSTEM

[75] Inventors: Kenichi Mabuchi, Matsudo; Kogiro Komatsu, Tokyo, both of Japan

[73] Assignee: Mabuchi Motor Co., Ltd., Tokyo, Japan

[21] Appl. No.: 894,650

[22] Filed: Apr. 10, 1978

[30] Foreign Application Priority Data

Apr. 15, 1977 [JP] Japan ..... 52/43226
Apr. 15, 1977 [JP] Japan ..... 52/43227

[51] Int. Cl.[2] ..... H04B 7/00; A63H 30/04; B60L 15/32

[52] U.S. Cl. ..... 325/37; 180/6.5; 46/254; 338/135

[58] Field of Search ..... 343/225; 325/37; 180/6.5, 98; 318/67, 68; 46/254

[56] References Cited

U.S. PATENT DOCUMENTS

| | | | |
|---|---|---|---|
| 3,387,582 | 6/1968 | Reeves | 343/225 |
| 3,596,154 | 7/1971 | Gurwicz et al. | 180/6.5 |
| 3,748,564 | 7/1973 | Ohba | 180/6.5 |

*Primary Examiner*—Kathleen H. Claffy
*Assistant Examiner*—Kenneth A. Chayt

[57] ABSTRACT

A radio control system having a radio-controlled model toy on which a d-c power supply, a receiver and two electric motors are mounted, and a transmitter for maneuvering the radio-controlled model toy, and characterized in that the transmitter is constructed so that a control pulse signal having a pulse level representing signal "1" and a pulse level representing signal "0" is transmitted and the duration of the signal "1" pulses is increased or decreased, and that the receiver is constructed so that driving current is supplied to a motor during the signal "1" pulse duration and to another motor during the signal "0" pulse duration.

8 Claims, 7 Drawing Figures

BATT
RC
M1
M2
ANT

RADIO MOTOR CONTROL SYSTEM

BACKGROUND OF THE INVENTION

1. Field of the Invention

This invention relates generally to a radio control system, and more specifically to a radio control system having a transmitter and a radio-controlled model toy on which a d-c power supply, a receiver and two motors are mounted, wherein a control pulse signal having a signal "1" level and a signal "0" level is transmitted from the transmitter, and the duration of the signal "1" or "0" level is increased or decreased so that the travelling direction, for example, of the model toy can be changed.

2. Description of the Prior Art

One of well-known radio control systems for maneuvering electric model airplanes, etc. is the digital proportional system, in which a plurality of servo-mechanisms are controlled by signals one cycle of which consists of a variable with control pulses corresponding to each servo-mechanism and a timing pulse. However, radio control systems based on the digital proportional system are generally too expensive to incorporate in model cars and other relatively simple model toys in which radio control is used only for changing the travelling direction.

In this type of radio-controlled model toys such as model cars, a radio control system having a receiver provided with two resonance circuits with slightly different resonance frequencies, and a transmitter capable of shifting the transmitting frequency either in positive or negative direction has been used. This system has such a construction that two motors are used to separately drive right and left wheels so that the travelling direction can be changed based on the difference in the output levels of the two resonance circuits in the receiver caused by shifting the transmitting frequency in the transmitter. However, there is a limit in miniaturizing resonance circuits because the resonance frequencies of the resonance circuits are usually in the low frequency band. This makes it difficult to apply such a radio control system to the design of small-sized model toys, such as model cars of approximately $5\times10\times5$ cm in size.

SUMMARY OF THE INVENTION

It is an object of this invention to provide a radio control system which solves the abomementioned points.

It is another object of this invention to provide a radio control system using an inexpensive radio control mechanism easily applicable to small-sized model toys in which a difference in the revolutions of two motors is caused by changing the pulse durations of control pulse signals having a signal "1" level and a signal "0" level.

DETAILED DESCRIPTION OF THE INVENTION

Figures 1, 2:
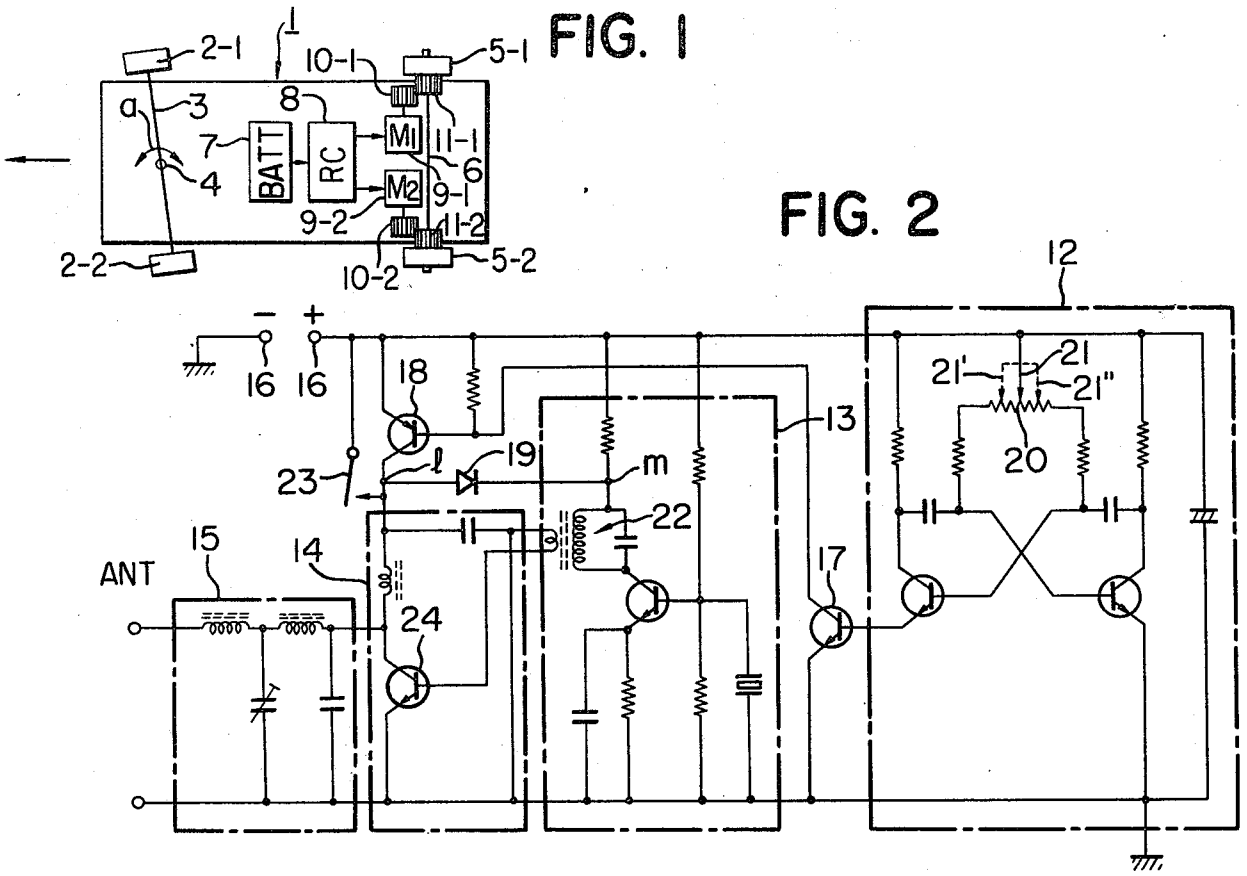
FIG. 1 shows a model toy controlled by a radio control system embodying this invention.
FIG. 2 is a circuit diagram of the transmitter of a radio control system embodying this invention.

FIG. 1 is a schematic plan view of a model car. In the figure, numeral 1 refers to a model toy; 2-1 and 2-2 to front wheels; 3 to a rotating axle which is fixedly connected to the front wheels 2-1 and 2-2 and is adapted to be rotatable around a shaft 4 in the direction shown by an arrow a in the figure; 5-1 and 5-2 to rear wheels; 6 to a rotating axle which races with respect to the rear wheels 5-1 and 5-2 and gears 11-1 and 11-2, which will be described later. Numeral 7 refers to a d.c. power supply; 8 to a receiver; 9-1 and 9-2 to motors having almost the same rotating characteristics; 10-1 and 10-2 to driven gears connected to the rotating shafts of the motors 9-1 and 9-2, respectively; 11-1 and 11-2 to driving gears in mesh with the driven gears 10-1 and 10-2 for driving the rear wheels 5-1 and 5-2, respectively.

Assuming that a predetermined level of driving current is supplied to the motor 9-1 and the motor 9-1 is running at a predetermined speed while the same level of driving current as above is supplied to the motor 9-2 and the motor 9-2 is also running at the same speed as the motor 9-1, the model car 1 travels straight on. In this state, if the driving current of the motor 9-1 increases and the driving current of the motor 9-2 decreases, the model car 1 turns counterclockwise. On the contrary, if the driving current of the motor 9-1 decreases and the driving current of the motor 9-2 increases, the model car 1 turns clockwise.

In this invention, as will be described later, driving currents for the motors 9-1 and 9-2 are controlled by a radio control system, a predetermined level of driving current is supplied to the motor 9-1 during the signal "1" duration, for example, of a control pulse signal having a predetermined frequency and the same level of driving current is supplied to the other motor 9-2 during the signal "0" duration, and the signal "1" duration is adapted to be increased or decreased. In this case, when the signal "1" duration is increased by $\Delta T$, the signal "0" duration is decreased by $\Delta T$. On the contrary, when the signal "1" duration is decreased by $\Delta T$, the signal "0" duration is increased by $\Delta T$.

Moreover, in this invention, the model car 1 is caused to stop by actuating a means for stopping modulation to discontinue the supply of driving current to the motors 9-1 and 9-2, as will be described later.

FIG. 2 is a circuit diagram of a transmitter of this invention. In the figure, numeral 12 refers to an astable multivibrator for generating a control pulse signal; 13 to a carrier wave generation circuit for generating a carrier wave; 14 to a modulation circuit for modulating the carrier wave generated in the carrier wave generation circuit 13 in accordance with the control pulse signal from the astable multivibrator 12; 15 to a turning circuit; 16 to power source terminals; 17 to a buffer amplifier; 18 to a switching transistor; 19 to a diode; 20 to a slide rheostat and 21 to the center tap thereof; 22 to a resonance circuit of the high frequency oscillation circuit 13; and 23 to a means for stopping modulation, or modulation stop means, respectively.

Figure 3:
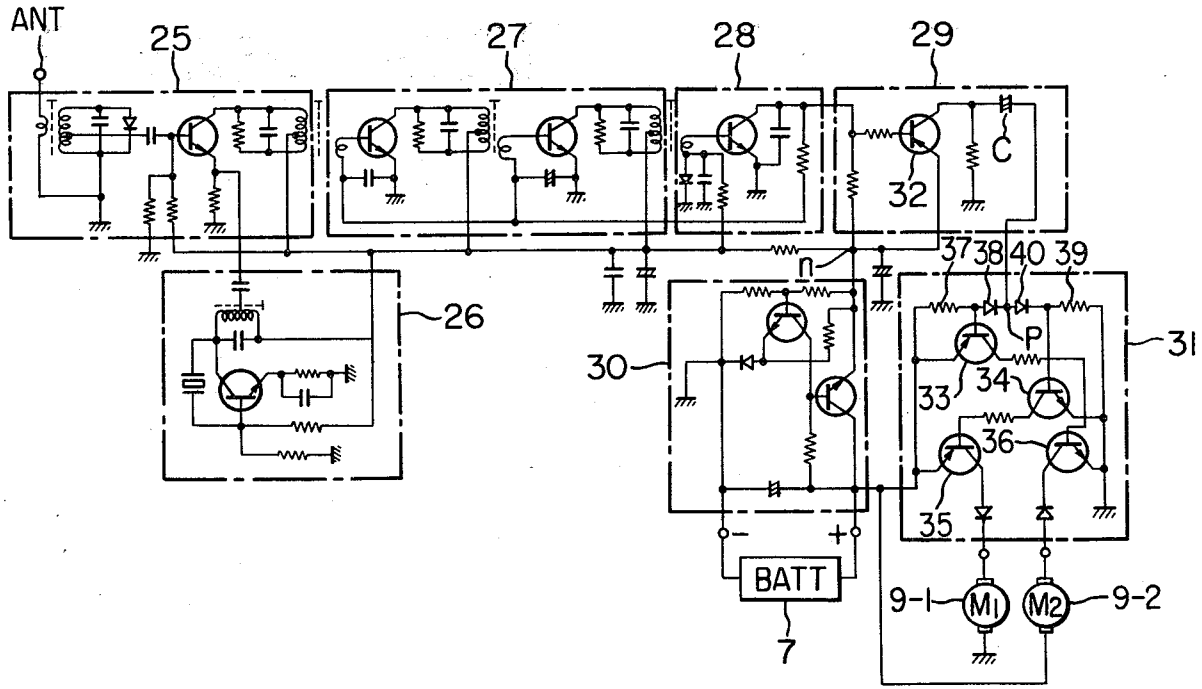
FIG. 3 is a circuit diagram of the receiver of a radio control system embodying this invention.

FIG. 3 is the circuit diagram of a receiver of this invention. In the figure, numeral 25 refers to a tuning and frequency mixing circuit; 26 to a local oscillation circuit; 27 to an intermediate frequency amplifier; 28 to a detection circuit; 29 to a low frequency amplifier circuit; 30 to an automatic voltage regulation circuit; 31 to a motor driving and controlling circuit; 32, 33, 34 35 and 36 to transistors; 37 and 39 to resistors; and 38 and 40 to diodes, respectively. Other numerals correspond to like numerals in FIG. 1.

In FIG. 3, when a voltage of, for example, 4.8 V is applied across the terminals of the d-c power supply 7, the point P in the figure is maintained at 2.4 V as the d-c level is discontinued when the transistor 32 in the low frequency amplifier circuit 29 is maintained in the normally on or off state. In such a case, the level of current flowing in the resistor 37 connected between the base and emitter of the transistor 33 is set to lower than the current level sufficient to turn on the transistor 33, and the level of current flowing in the resistor 39 connected between the base and emitter of the transistor 34 is set to lower than the current level sufficient to turn on the transistor 34. This causes the two motors 9-1 and 9-2 to stop. The operation of the radio control system shown in FIGS. 2 and 3 will be described in what follows, referring to FIGS. 4A and 4B.

[A] First, the operation of the system of this invention in the state where the means for stopping modulation or modulation stop means 23 is turned off, or the state shown in FIG. 2, will be described.

Figure 4A:
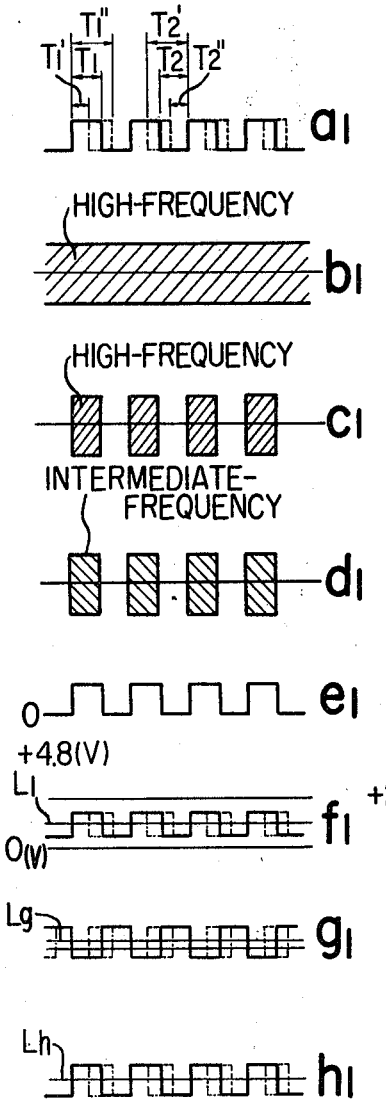
FIGS. 4A and 4B are diagrams of assistance in explaining this invention.

(1) When the center tap 21 of the slide rheostat 20 in the astable multivibrator 12 is in the zero position (the central position on the slide rheostat 20) as shown by a solid line in FIG. 2, a control pulse signal outputted by the astable multivibrator 12 assumes the form shown by a solid line in the waveform a1 in FIG. 4A. That is, the time width T1 corresponding to the signal "1" duration is equal to the time width T2 corresponding to the signal "0" duration. The frequency of the abovementioned control pulse signal is 1 kHz, for example.

(2) On the other hand, the carrier wave generation circuit 13 produces a high frequency of 27 MHz, for example, as shown by the waveform b1 in FIG. 4A.

(3) The said high frequency b1 is applied to the base of the transistor 24 in the modulation circuit 14. The on-off state of the switching transistor 18 is controlled by the said control pulse signal a1.

(4) Consequently, the output signal of the modulation circuit 14 assumes the waveform c1 in FIG. 4A, and the signal c1 is transmitted from a transmitting antenna ANT.

(5) The said signal c1 transmitted from the transmitter is received by a receiving antenna ANT in FIG. 3, the converted into an intermediate frequency signal (the waveform d1 in FIG. 4A) of, for example, 500 kHz in the tuning and frequency mixing circuit 25.

(6) Then, the intermediate frequency signal d1 is amplified in the intermediate frequency amplifier 27, and detected in the detection circuit 28 to form a signal as shown by the waveform e1 in FIG. 4A.

(7) The signal e1 is amplified in the low frequency amplifier circuit 29 and applied to the motor driving and controlling circuit 31.

(8) Consequently, the voltage waveform at the poiint p shown in the figure in the motor driving and controlling circuit 31 is given by the waveform f1 shown in FIG. 4A. In the waveform f1, the level L1 in the figure corresponds to the level of 2.4 V when a voltage of 4.8 V is applied across the terminals of the d-c power supply. The higher level voltage value in the waveform f1 is set to the voltage level sufficient to turn on the transistor 34 and the lower level voltage level in the waveform f1 is set to the voltage level sufficient to turn on the transistor 33.

(9) Consequently, during the higher level period in the voltage waveform f1, the transistors 34 and 36 are kept conducting and the transistors 33 and 35 are kept non-conducting. On the other hand, the transistors 34, 35, 36 and 37 are kept in the reversed state of the above.

(10) The driving current supplied to the motor 9-1, therefore, assumes the form shown by a solid line in the waveform g1 in FIG. 4A while the driving current supplied to the other motor 9-2 assumes the form shown by a solid line in the waveform h1 in FIG. 4A.

(11) In this case, the average level (the level Lg shown in the waveform g1) of the driving current for the motor 9-1 becomes equal to the average level (the level Lh shown in the wveform h1) of the driving current for the motor 9-2, as is evident from the waveforms g1 and h1.

(12) Consequently, the revolution of the motor 9-1 becomes equal to that of the motor 9-2. Thus, the model car shown in FIG. 1, for example, travels straight on.

(13) In the meantime, when the center tap 21 of the slide rheostat 20 in the astable multivibrator 12 is moved from the zero position on the scale leftward in the figure to the position 21' in FIG. 2 with respect to the slide rheostat 20, the control pulse signal outputted by the astable multivibrator 12 assumes the waveform shown by alternate long and short dash line in the waveform a1 in FIG. 4A. That is, a control pulse signal with the duration T1' of the signal "1" shorter than the duraftion T2' of the signal "0" duration is outputted. Thus, a modulated wave corresponding to the control pulse signal is transmitted from the transmitter, and the voltage waveform at the point P in FIG. 3 on the receiver side assumes the waveform shown by alternate long and short dash lines in the waveform e1 in FIG. 4A. Consequently, the driving current to the motor 9-1 assumes the waveform shown by alternate long and short dash lines in the waveform g1 in FIG. 4A while the driving current to the motor 9-2 assumes the waveform shown by alternate long and short dash lines in the waveform h1 in FIG. 4A. In other words, the revolution of the motor 9-1 becomes higher than that of the motor 9-2, causing the model car shown in FIG. 1, for example, to turn counterclockwise.

(14) On the other hand, when the center tap 21 of the slide rheostat 20 is moved to the position 21'' shown in FIG. 2, the control pulse signal assumes the waveform shown by broken lines in the waveform a1 in FIG. 4A, and the voltage waveform at the point P in FIG. 3 also assumes the waveform shown by broken lines in the waveform f1 in FIG. 4A. Consequently, the driving current to the motor 9-1 becomes smaller than that to the motor 9-2, causing the model car shown in FIG. 1 to turn clockwise.

Figure 4B:
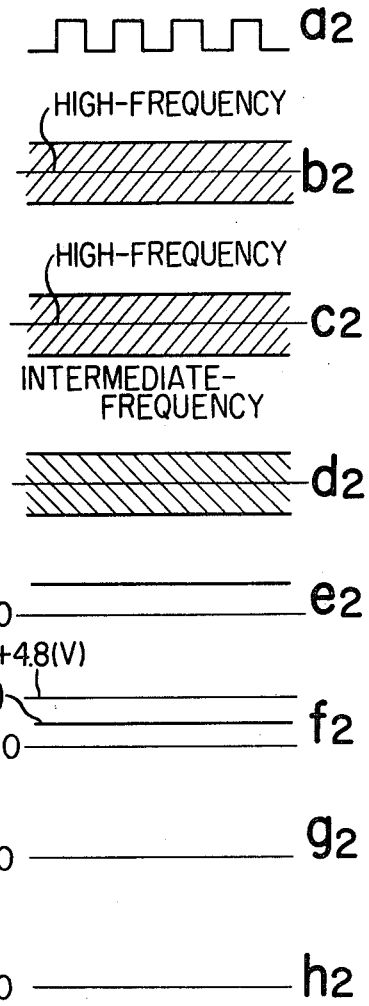

[B] Next, the operation of the system when the modulation stop means 23 is turned on in the state where a control pulse signal as shown by a2 in FIG. 4B is outputted by the astable multivibrator 12 will be described.

(15) In this case the switching transistor 18 is forcibly short-circuited by the modulation stop means 23 independently of the waveform of the control pulse signal from the astable multivibrator 12.

(16) Consequently, the output signal of the modulation circuit 14 becomes a continuous waveform, as shown by the waveform c2 in FIG. 4B, corresponding to the carrier wave generated in the carrier wave generation circuit 13, as shown by the waveform b2 in FIG.

4B, and transmitted from the transmitting antenna ANT via the tuning circuit 15.

(17) Consequently, the output signal of the tuning/-frequency conversion circuit 25 in the receiver becomes an intermediate frequency as shown by the waveform d2 in FIG. 4B, the output signal of the low frequency amplifier circuit 29 assumes the waveform e2 in FIG. 4B and the voltage waveform at the point P in FIG. 3 assumes the waveform f2 in FIG. 4B. That is, the potential at the point P is maintained at a predetermined level. The level is 2.4 V when the terminal voltage of the battery 7 is 4.8 V, as described above.

(18) This keeps the transistors 33, 34, 35 and 36 in the motor driving and controlling circuit 31 in the OFF state, as described above. Both the motors 9-1 and 9-2, therefore, are not driven. That is, the model car shown in FIG. 1, for example, stops.

In this way, a single control pulse signal can generate a differential in the revolution of the two motors 9-1 and 9-2, and at the same time, can easily control the start and stop of the motors. The function of the modulation stop means is not limited to nullification of the control pulse signal from the astable multivibrator, but the means may have such functions as to turn off the power supply of the transmitter, for example, and to nullify the function of the carrier wave generation circuit.

In FIG. 2, the diode 19 is connected between the collector terminal l of the switching transistor 18 and the terminal m on the power supply positive side of the resonance circuit of the high frequency oscillation circuit 13. The potential of the terminal m is, therefore, maintained at a low level when the switching transistor 18 is in the OFF state. On the other hand, when the switching transistor 18 is in the ON state, the diode 19 conducts to bring the potential of the terminal m at a high level. Consequently, the output voltage of the resonance circuit 22 is maintained at a high level when the switching transistor 18 is in the ON state. This causes the output level of the control pulse signal transmitted from the antenna ANT via the tuning circuit 15 to increase. In this way, the output level of the transmitter can be easily increased during the period when the transistor 18 is in the ON state by connecting the diode 19.

Figure 5A:
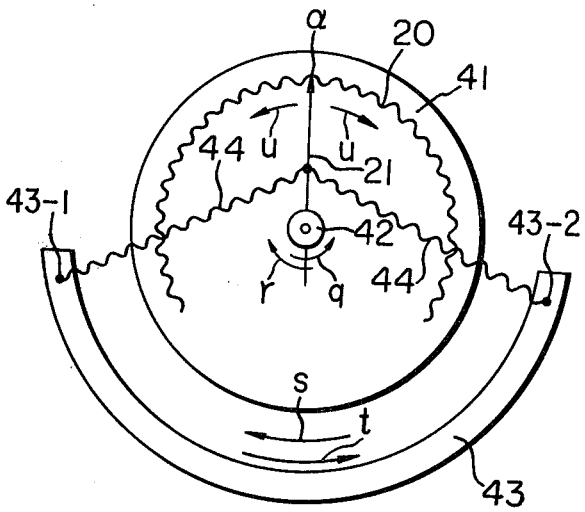
FIGS. 5A and 5B are diagrams of assistance in explaining the relation between a slide rheostat and the wiper arm thereof in the transmitter.
Figure 5B:
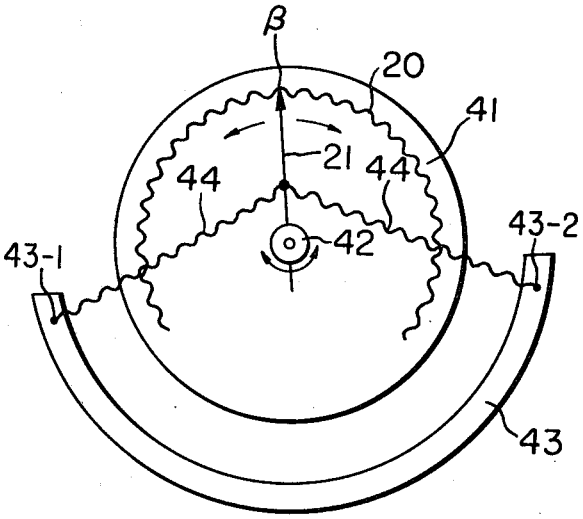

FIGS. 5A and 5B are schematic representation illustrating the relationship between the slide rheostat 20 and the wiper arm, or center tap, thereof 21 in the transmitter shown in FIG. 2. In the figure, numeral 41 refers to a mount on which the slide rheostat 20 is fixedly mounted; 42 to a shaft which is connected to a knob provided on the external case (not shown) of the transmitter, and is rotatable in either directions shown by arrows q and r in the figure, and on which the center tap is fixed; 43 to a center tap with respect to the mount 41 support which is rotatable in either directions shown by arrows s and t in the figure; 44 and 44 to a resilient means or a spring provided between supporting points 43-1 and 43-2 on the center tap support 43 and the center tap 21, respectively. The center tap support 43 is rotated with a sliding arm provided on the external case (not shown) of the transmitter in either directions shown by arrows s and t in the figure.

Now, assume that the center tap support 43 is held in such a relation as shown in FIG. 5A with respect to the mount 41. The center tap 21 in this state is located at the zero scale position $\alpha$ on the rheostat. In this state when the shaft 42 is rotated in the direction shown by arrow q, for example, by turning the knob (not shown) by hand, the center tap 21 is rotated in the direction shown by arrow u while sliding on the rheostat 20, resisting the resiliency of the spring 44 and 44. When the knob is released, the center tap 21 is restored to the original position shown in FIG. 5A by the resiliency of the spring 44. In this manner, the position of the center tap 21 on the rheostat 20 can be easily changed, that is the revolution of the motors 9-1 and 9-2 can be controlled in the opposite direction with each other by turning the knob.

It is usually assumed that the revolution of the motor 9-1 is equal to that of the motor 9-2 in the state where the center tap 21 is held at the zero scale position $\alpha$ as shown in FIG. 5A. However, because of the difficulty in selecting two motors having exactly the same characterstics, the two motors 9-1 and 9-2 having often different revolutions even in the state where the center tap is held at the zero scale position $\alpha$. To overcome this problem, this invention has a provision for adjusting the zero scale position so that the revolutions of the motors 9-1 and 9-2 become equal.

That is, the center tap support 43 is moved in the direction shown by arrow t in FIG. 5A with respect to the mount 41. Thus, the movement of the center tap 21 is stopped and maintained at the position $\beta$ in FIG. 5B, or a position where the revolutions of the motors 9-1 and 9-2 become equal. By doing so, the center tap position at which the revolutions of the motors 9-1 and 9-2 become equal can be easily selected. In addition, by taking advantage of the abovementioned position adjustment mechanism of the center tap support 43, a model car can be controlled so that it can move around a circle of desired radius.

What is claimed is:

1. A radio control system for use in a radio-controlled model toy on which a d-c power supply, a receiver and two motors are mounted, and a transmitter for controlling the radio-controlled model toy, and characterized in that the transmitter has such a construction that a control pulse signal having a signal "1" level and a signal "0" level is transmitted and the duration of the signal "1" level is increased or decreased, and that the receiver has such a construction that driving current is fed to a motor during the signal "1" duration and to another motor during the signal "0" duration.

2. A radio control system as set forth in claim 1 wherein the transmitter has a modulation stop means and the receiver has a motor driving and controlling circuit for controlling driving current to the motors based on the output signal obtained by the receiver, and characterized in that the motor driving and controlling circuit is constructed so as to stop the supply of driving current to the two motors when the modulation stop means causes modulation to stop.

3. A radio control system as set forth in claim 2 wherein the transmitter has an astable multivibrator for generating a signal wave corresponding to the control pulse signal, a high frequency oscillation circuit for generating a carrier wave and a modulation circuit for modulating the carrier wave generated by the high frequency oscillation circuit in accordance with the signal wave generated by the astable multivibrator, and characterized in that the astable multivibrator has a slide rheostat capable of changing the pulse duration of the signal wave.

4. A radio control system as set forth in claim 3 wherein the motor driving and controlling circuit has transistors connected in series with each of the two motors and a control circuit for controlling the base potential of the transistors, and characterized in that the control circuit is constructed so as to turn off each of the transistors connected in series with the motors when modulation is stopped.

5. A radio control system as set forth in claim 3 wherein the transmitter has a switching transistor the base current of which is controlled by the control pulse signal from the astable multivibrator and the output of which is connected to the modulation circuit, and characterized in that the modulation stop means is constructed so as to nullify the on-off control of the switching transistor.

6. A radio control system as set forth in claim 5 wherein the transmitter has a diode connected between the output end of the switching transistor and the power source terminal of the high frequency oscillation circuit so that a high power source voltage is applied to the high frequency oscillation circuit during the period when the switching transistor is in the on state.

7. A radio control system as set forth in claim 3 wherein the receiver has an automatic voltage regulation circuit so that the B power supply voltage of the receiver is maintained at a predetermined level.

8. A radio control system as set forth in claim 3 characterized in that the transmitter is constructed so that the wiper arm of the slide rheostat is held by a spring approximately at the center of the zero scale position of the slide rheostat, and the zero scale position can be shifted independently of the relative position at which the wiper arm is held by the spring.

* * * * *